US005114904A

United States Patent [19]

Kawakami et al.

[11] Patent Number: 5,114,904

[45] Date of Patent: May 19, 1992

[54] THERMAL TRANSFER RECORDING MEDIUM AND IMAGE FORMING BODY

[75] Inventors: Takeo Kawakami, Noda; Takashi Kagami, Tokyo; Yosei Chosa, Yokohama; Masato Yoshida, Kasukabe, all of Japan

[73] Assignee: Toppan Printing Co., Tokyo, Japan

[21] Appl. No.: 630,880

[22] Filed: Dec. 20, 1990

Related U.S. Application Data

[62] Division of Ser. No. 222,906, Jul. 22, 1988, abandoned.

[30] Foreign Application Priority Data

| | | | |
|---|---|---|---|
| Jul. 27, 1987 | [JP] | Japan | 62-187074 |
| Jul. 27, 1987 | [JP] | Japan | 62-187075 |
| Jan. 18, 1988 | [JP] | Japan | 63-7814 |
| Apr. 8, 1988 | [JP] | Japan | 63-86363 |

[51] Int. Cl.[5] ..... B41M 5/035; B41M 5/26

[52] U.S. Cl. ..... 503/227; 428/195; 428/447; 428/480; 428/500; 428/913; 428/914

[58] Field of Search ..... 8/471; 428/195, 447, 428/913, 914, 480, 500; 503/227

[56] References Cited

U.S. PATENT DOCUMENTS

| | | | |
|---|---|---|---|
| 4,567,114 | 1/1986 | Oshima et al. | 428/480 |
| 4,650,494 | 3/1987 | Kutsukake et al. | 8/471 |
| 4,720,480 | 1/1988 | Ito et al. | 503/227 |
| 4,968,658 | 11/1990 | Beck et al. | 503/227 |
| 4,992,413 | 2/1991 | Egashira et al. | 503/227 |

FOREIGN PATENT DOCUMENTS

| | | | |
|---|---|---|---|
| 0180396 | 5/1986 | European Pat. Off. | 503/227 |
| 3507097 | 9/1985 | Fed. Rep. of Germany | 503/227 |
| 3536340 | 4/1986 | Fed. Rep. of Germany | 503/227 |
| 3623483 | 1/1987 | Fed. Rep. of Germany | 503/227 |
| 59-194892 | 11/1984 | Japan | 503/227 |
| 60-101087 | 6/1985 | Japan | 503/227 |
| 61-27292 | 2/1986 | Japan | 503/227 |
| 61-211092 | 9/1986 | Japan | 503/227 |

OTHER PUBLICATIONS

European Search Report, dated Jul. 25, 1990, cited in EP 88 11 2068.

*Primary Examiner*—Bruce H. Hess

*Attorney, Agent, or Firm*—Bacon & Thomas

[57] ABSTRACT

A thermal transfer recording medium such as a color thermal transfer paper or ribbon which is used in combination with a thermal head or pen to print an image on an image forming body or sheet. The thermal transfer recording medium comprises a polyester supporting film, a first thermal transfer layer formed on the supporting film, which consists mainly of a saturated polyester copolymer having a molecular weight of 8,000 to 30,000 and containing a sublimation or hot-melt transfer dye. A second thermal transfer layer containing a dye as that of the first transfer layer may be formed on the first transfer layer. The thermal transfer image forming body comprises a supporting body, a dyeing image forming layer formed on the supporting body and made mainly of a thermoplastic resin having four or more OH group per molecule, a tensile break strength of 300 kg/cm$^2$ or more and tensile break elongation of 20% or more, and a surface layer made of a silicone resin.

3 Claims, 1 Drawing Sheet

THERMAL TRANSFER RECORDING MEDIUM AND IMAGE FORMING BODY

This application is a division of application Ser. No. 07/222,906, filed Jul. 22, 1988 is now abandoned.

BACKGROUND OF THE INVENTION

1. Field of the Invention

The present invention relates to a thermal transfer recording medium, such as color thermal transfer paper or a color thermal transfer ribbon, which is capable of reproducing gradation of, for example, photographs as it is used in a thermal recording system by means of a thermal recording member, such as a thermal head or a thermal pen, and also relates to an image forming body (on which an image is printed) suitable for use in the thermal transfer recording system.

2. Description of the Prior Art

According to one method of reproducing, in printed form, image data contained in, for example, a video signal, by means of a thermal recording device such as a thermal head or a thermal pen, a thermal transfer recording medium obtained by forming a transfer layer containing a heat sublimation transfer disperse dye or a hot-melt evaporation transfer dye on a substrate sheet is superposed on a transfer medium, thereby transferring the image information.

A butyral resin is mainly used as a binder for the transfer layer.

In order to perform clear printing based on a video signal or the like in accordance with the above method, a thermal transfer recording medium must smoothly form from a high density portion to a low density portion in correspondence to energy applied by a thermal head. However, if high energy is applied from the thermal head, not only is an image transferred to an image forming body but also the binder contained in the transfer layer of the transfer recording medium. On the other hand, if a low energy is applied, transfer by sublimation or evaporation is not sufficiently performed. Therefore, it is difficult to transfer a dye with gradation in correspondence to an image signal.

According another image transfer method, a thermal transfer sheet including a sublimation disperse dye layer in which an amount of a dye to be transferred can be changed in accordance with a heat amount of a thermal head is used to control an amount of a sublimation dye, thereby obtaining a photographic image with gradation (Image Electronics Society, Vol. 12, No. 1, 1983).

As a technique similar to the above method, dry transfer printing with respect to a polyester fiber is already known. According to this method, a dye such as a sublimation disperse dye is dispersed or dissolved in a synthetic resin solution, so as to obtain a color material, and the color material is printed in a pattern on thin paper and dried to prepare a transfer sheet. Then, the transfer sheet is superposed on a cloth formed of polyester fibers and transferred with heat and pressure to transfer the dye into the polyester fibers, thereby obtaining an image. However, it is difficult to obtain an image having high density even if printing is performed by a thermal head using this transfer paper. The reasons for this are as follows:

The dye used in this transfer paper can be transferred upon heating by a hot plate at 200° C. for about 60 seconds. Therefore, since a heat amount is small, i.e., applied from the thermal head at about 250° C. for only several milliseconds (n/1000 sec; n=an integer below 10), transfer is not sufficiently performed. Moreover, a thickness of the thin paper is as small as at most 10 μm. Therefore, it is difficult to increase a temperature of the transfer layer in a short period of time up to a temperature at which a heat amount is absorbed in the paper to sublimate and transfer the dye.

Various improvements in which, e.g., a film is formed very thin (6 to 9 μm) have been proposed although they are basically the same as the above principle.

Examples are Japanese Patent Disclosure (Kokai) Nos. 60-994 and 60-101087. In these methods, however, it is difficult to obtain an image having high density. Meanwhile, if a high energy is applied to obtain an image having high density, a printing speed is reduced to reduce a service life of a thermal head.

Another problem of the thermal recording medium having the thermal transfer layer in which the dye is sublimited or melted to be transferred with heat is a phenomenon in which a resin constituting the transfer layer of the recording medium partially is transferred to a transfer medium, i.e., an image forming body during transfer. When not only the dye but also the resin are transferred during transfer recording, density control of a transferred image becomes insufficient, and therefore gradation cannot be accurately formed. In order to eliminate such a drawback, Japanese Patent Disclosure (Kokai) Nos. 59-14994, 59-71898, 61-189994, and 61-188193 propose methods in which a polyamide resin is used as a binder resin constituting the transfer layer. According to these methods, adhesion of the transfer layer to a supporting body is more or less improved to reduce migration of the resin to the image forming body. However, during storage, the transfer layer easily absorbs humidity, the dye in the transfer layer tends to be transferred, or the dye tends to be transferred to a material superposed thereon even while heat is not applied. Therefore, these methods are not sufficient in terms of storage stability.

Meanwhile, an image forming body for forming a transfer image from a thermal transfer medium containing a sublimation dye in a thermal transfer layer must have good dyeing property, light resistance, chemical resistance, and abrasion resistance, and the thermal transfer medium and the image forming body must have a blocking (resin film peeling) preventing property during printing. Furthermore, in recent years, in order to form an image on the basis of information of, e.g., a video signal, a thermal transfer medium using a sublimation dye has been increasingly used. Therefore, a demand has arisen for an improvement in storage stability, especially, a plasticizer resistance or a retransfer resistance of the formed image.

In order to transfer the sublimation dye of the thermal transfer medium to the image forming body well to form colors, a resin at the image forming body side must have a good dyeing property with respect to the sublimation dye. The dyeing property of the resin is better when a softening point and a glass transition point are lower. However, the resin having the good dyeing property tends to be melted to cause blocking with a resin which holds the sublimation dye of the thermal transfer medium during thermal transfer. In addition, the sublimation dye once dyed tends to be sublimated again to degrade image quality. A blocking phenomenon in thermal transfer is also associated with a resin coating amount with respect to the transfer medium. Therefore, a certain countermeasure must be performed to the resin layer of the image forming body to prevent blocking especially from the dye transfer medium side to the image forming body side. For example, the surface resin layer of the image forming body may be hardened to obtain a heat resistance. In this case, however, it is difficult to transfer the sublimation dye of the transfer medium to the image forming body, thereby degrading image density.

In addition, an additive such as a silicone oil may be mixed in the resin layer of the image forming body, or the silicone oil or the like may be coated on the resin surface of the image forming body to activate the image forming body surface. In this case, however, the image forming body surface becomes viscous and dirt tends to be adhered thereon, thereby posing a problem of finger print resistance. As described above, a good dyeing property of the sublimation dye from the transfer medium to the image forming body is in a reciprocal relationship with the storage stability after dyeing, and no countermeasure is proposed so far.

SUMMARY OF THE INVENTION

The present invention has been made in consideration of the above situation and has as its object to provide a thermal transfer recording medium in which adhesion of a thermal transfer layer with respect to a supporting body is sufficient and only a dye in the thermal transfer layer is transferred to an image forming body during transfer recording, thereby accurately forming a transfer image smoothly from a low density portion to a high density portion, and which has good storage stability.

It is another object of the present invention to provide a thermal transfer image forming body which can form a dye transfer image having high density without generating resin transfer from a thermal transfer medium containing a sublimation dye in a thermal transfer layer and has good finger print resistance and storage stability.

Accordingly, the present invention provides a thermal transfer recording medium comprising: a film-like supporting body consisting of a polyester resin; and a first thermal transfer layer, formed on the supporting body, consisting mainly of a saturated copolymer polyester resin having a molecular weight of 8,000 to 30,000, and containing a sublimation or hot-melt transfer dye.

The present invention also provides a thermal transfer recording medium as described above, wherein a second thermal transfer layer is formed on the first transfer layer, consists mainly of a thermoplastic vinyl acetal resin and contains a sublimation or hot-melt transfer dye the same color as that of the first thermal transfer layer.

The present invention additionally provides a thermal transfer image forming body which comprises: a supporting body; a dyeing image forming layer formed on the supporting body and consisting mainly of a thermoplastic resin having four or more hydroxyl groups per molecule, a tensile break strength of 300 kg/cm$^2$ (ASTM D638) or greater, a tensile break elongation of 20% (ASTM D638) or greater, and a dyeing property with respect to a sublimation or hot-melt transfer dye; and a surface layer, formed on the dyeing image forming layer and containing a dye-permeating lubricant consisting of an addition reaction or condensation reaction type curing silicone resin.

The present invention further provides a thermal transfer image forming body which comprises: a supporting body; and a dyeing image forming body, formed on the supporting body, consisting mainly of a thermoplastic resin having four or more hydroxyl groups per molecule, a tensile break strength of 300 kg/cm$^2$ (ASTM D638) or greater, a tensile break strength of 20% (ASTM D638) or greater, and a dyeing property with respect to a sublimation or hot-melt migration dye, and containing a dye-permeating lubricant consisting of an addition reaction or condensation reaction type curing silicone resin.

In addition to the above, the present invention also provides a thermal transfer system using an arbitrary combination of the thermal transfer recording medium and the thermal transfer image forming body.

DETAILED DESCRIPTION OF THE PREFERRED EMBODIMENTS

Figure 1:
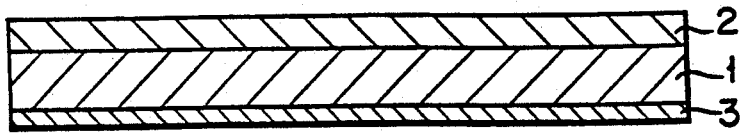
FIG. 1 is a section al view of a thermal transfer recording medium according to an embodiment of the present invention.

The present invention will be described in detail below, by way of its embodiments as shown in the drawings.

FIG. 1 is a sectional view of a thermal transfer recording medium according to an embodiment of the present invention. In FIG. 1, reference numeral 1 denotes a film-like supporting body consisting of a polyester resin; and 2, a first thermal transfer layer which is formed on supporting body 1.

The thickness of supporting body 1 is preferably 4.0 to 9.0 μm. First thermal transfer layer 2 can be constituted by a composition consisting mainly of a saturated copolymer polyester resin having a molecular weight of 8,000 to 30,000 and containing a sublimation or hot-melt transfer dye. Layer 2 is formed by dissolving the above composition in an organic solvent, such as toluene or methyl ethyl ketone, and coating the resultant material on supporting body 1 to a thickness of not greater than 2 μm (in a dry state), by use of an arbitrary coating method, since if the thickness of layer 2 exceeds 2 μm, its heat sensitivity is undesirably degraded.

More preferably, layer 2 is made of a saturated copolymer polyester resin having a glass transition temperature of 1° to 70° C. (DSC method), and most preferably, is made of a saturated copolymer polyester resin having a molecular weight of about 20,000 and a glass transition temperature of 10° to 70° C. When the glass transition temperature is limited in this manner, dye tends to be released from a binder resin when it is heated by a thermal head, and the ink surface is not rendered viscous. If the glass transition point of the saturated copolymer polyester resin is 10° C. or less, the ink surface becomes viscous and is adhered to image forming paper during the transfer, thereby degrading printing quality. If the glass transition point is 70° C. or more, the dye is not easily released from the binder resin, resulting in poor transfer efficiency at a low energy and degradation in reproducibility at a low-density portion. The glass transition temperature of the polyester is preferably 10° to 50° C. in the case of heat sublimation transfer disperse dye, and 10° to 70° C. in the case of a hot-melt evaporation transfer dye. The molecular weight is set within the range of 8,000 to 30,000 because the binder resin which is softened by heating maintains adhesion with respect to the substrate.

Note that if necessary, a protecting layer 3 for example a sticking-prevention layer consisting of, e.g., a phosphate surface active agent may be formed on the rear surface of supporting body 1.

Figure 2:
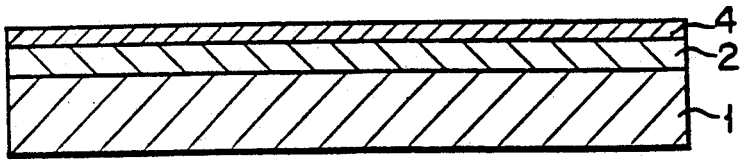
FIG. 2 is a sectional view of a thermal transfer recording medium according to another embodiment of the present invention.

FIG. 2 shows a thermal transfer recording body according to another embodiment of the present invention, which differs from that shown in FIG. 1 only in that it has a second thermal transfer layer 4, which is formed on the upper surface of first thermal transfer 2 of the thermal transfer recording body.

Consequently, the reference numerals used to denote parts in the first embodiment denote the same parts in the second embodiment, and thus a detail description thereof will be omitted.

Second thermal transfer layer 4 is made up of a composition which consists mainly of a thermoplastic vinyl acetal resin and contains a dye the same color as that of the sublimation or hot-melt migration dye of layer 2. The resin binder should preferably be a solvent-soluble thermoplastic vinyl acetal type having a molecular weight of 10,000 to 80,000. However, since only the dye must be released or permeated during thermal transfer recording, the molecular weight of the resin is more preferably 30,000 to 50,000. A layer 4 consisting mainly of this resin should preferably be as thin as possible, for example, 2 μm or less.

Examples of a dye to be kneaded in the resins of the first and second thermal transfer layers are a disperse dye and an oil-soluble dye having a molecular weight of 200 to 500.

The second thermal transfer layer having the above arrangement is formed at the supporting body side with good adhesion because the first thermal transfer layer is formed below it.

As described above, the thermal transfer recording medium of the present invention is obtained by forming the first thermal transfer layer consisting mainly of a saturated copolymer polyester resin, or sequentially forming the first thermal transfer layer and the second thermal transfer layer consisting mainly of a thermoplastic vinyl acetal resin on the supporting body consisting of a polyester resin. Therefore, as compared with a conventional recording medium obtained by forming a thermal transfer layer having a polyamide resin or a butyral resin as a binder resin on a supporting body consisting of a polyester resin, the following effects can be achieved:

(1) Since the level of adhesion of the thermal transfer layer with respect to the supporting body is high, the resin in the transfer layer is not transferred along with the dye to the image forming body during thermal transfer recording.

(2) Since only the dye is transferred to the image forming body, the colors formed at a recorded portion are clear. In addition, since the dye can be sublimated and transferred in accordance with the amount of heat energy applied, photographic gradation reproducibility is improved.

(3) Since the resin binder is not transferred to the image forming body, the gloss of a recorded image is not degraded.

A thermal transfer image forming body which can be used in combination with the above thermal transfer recording medium in the present invention will now be described below.

Figure 3:
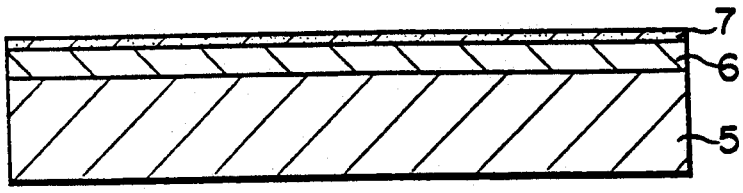
FIG. 3 is a sectional view of a thermal transfer image forming body according to the embodiment shown in FIG. 1.

FIG. 3, shows thermal transfer image forming body according to one embodiment of the present invention, which is obtained by sequentially forming at least dye image forming layer 6, which has good dyeing properties with respect to a sublimation dye, and surface resin layer 7, which contains a dye-permeating lubricant, on supporting body 5, which is made of, for example, paper, plastic, or an inorganic sheet.

Layer 6 consists mainly of a thermoplastic polyester resin having four or more hydroxyl groups, a tensile break strength of 300 kg/cm$^2$ (ASTM D638) or greater, and a tensile break elongation of 20% (ASTM D638) or greater. When the thermoplastic polyester resin having the above properties is mainly used to form layer 6, the layer can obtain a good dyeing property as that of a resin having low softening point and glass transition point although a softening point and a glass transition point of the layer are high.

A dye image can be formed on layer 6 having the above arrangement by a thermal transfer recording medium containing a sublimation dye in a thermal transfer layer. However, a binder resin in the thermal transfer layer tends to be transferred. Therefore, in the present invention, surface resin layer 7 is formed on dye image forming layer 6. Layer 7 is formed of a thermoplastic resin containing an addition reaction or condensation reaction type curing silicone resin. Layer 7 does not interface with transfer recording with respect to layer 6, prevents resin transfer or contamination from the thermal transfer layer of the thermal transfer recording medium, and improves storage stability, especially a light resistance and a plasticizer resistance of the image forming body after the dye image is transferred.

The image forming body having the above arrangement may be formed by coating a thermoplastic polyester resin dissolved in a 2-butanone or toluene-2-butanone mixture solvent and having the above properties to a thickness of about 4 to 6 μm and coating thereon a thermoplastic resin containing an addition reaction or condensation reaction type curing silicone resin added with a catalyst (1 to 2 parts in solid content with respect to 100 parts of a silicone resin solid content). A fine powder of, e.g., an inorganic filler may be added in layer 6 or 7.

Table-1 shows improvements in the blocking preventing property, dyeing property, and storage stability obtained when the surface resin layer containing the addition reaction or condensation reaction type curing silicone resin is formed on the dye image forming layer mainly consisting of a thermoplastic polyester having a different tensile break strength and tensile break elongation as compared with those obtained when no surface resin layer is formed.

TABLE 1

| Dye Image Forming Layer (Thermoplastic Polyester Resin) | | | | | |
|---|---|---|---|---|---|
| Tensile Break Strength | Tensile Break Elongation | Surface Resin Layer | Blocking Preventing Property | Dyeing Property | Storage Stability |
| 300 kg/cm$^2$ | 20% or more | Present | ○ | ○ | ○ |
| or more | less than 200% | Not present | x | ○ | ○ |
| less than | less than 20% | Present | ○ | x | ○ |
| 800 kg/cm$^2$ | | Not present | x | x | Δ |
| (ASTM D 638) | 200% or more | Present | ○ | ○ | Δ |
| | | Not present | x | ○ | Δ |
| less than | 20% or more | Present | ○ | Δ | ○ |
| 300 kg/cm$^2$ | less than 200% | Not present | x | x | Δ |
| (ASTM D 638 | less than 20% | Present | ○ | x | ○ |
| | | Not present | x | x | Δ |
| | 200% or more | Present | ○ | ○ | Δ |
| | | Not present | x | ○ | Δ |
| 800 kg/cm$^2$ | 20% or more | Present | ○ | Δ | ○ |
| or more | less than 200% | Not present | x | x | Δ |
| (ASTM D 638) | less than 20% | Present | ○ | x | ○ |
| | | Not present | x | x | Δ |
| | 200% or more | Present | ○ | ○ | Δ |
| | | Not present | x | ○ | Δ |

As is apparent from Table-1, even if the surface resin layer consisting of the thermoplastic resin containing the addition reaction or condensation reaction type curing silicone resin is formed, transfer or melting of the binder resin in the thermal transfer layer with respect to dye image forming layer 6 caused by a peeling effect of the silicone resin does not occur when the thermoplastic polyester resin forming the dye image forming layer has four or more hydroxyl groups, a tensile break strength of 300 kg/cm$^2$ (ASTM D638) or more, and a tensile break elongation of 20% (ASTM D638) or more. Therefore, only the dye can be efficiently transferred to layer 6, and density of the transfer image and storage stability, especially a light resistance and plasticizer resistance after dye transfer can be significantly improved because the dyeing resin having the above properties is selected.

Figure 4:
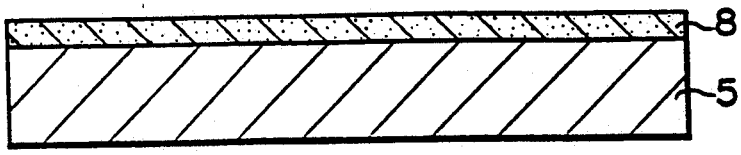
FIG. 4 is a sectional view of a thermal transfer image forming body according to the embodiment shown in FIG. 2.

FIG. 4 shows another embodiment of the thermal transfer image forming body of the present invention, obtained by forming at least dyeing image forming layer 8 having a good dyeing property with respect to a sublimation dye on substrate 5 consisting of, e.g., paper, plastic, or an inorganic sheet.

Layer 8 is constituted by a composition mainly consisting of a thermoplastic polyester resin having four or more hydroxyl groups, a tensile break strength of 300 kg/cm$^2$ (ASTM D638) or more, and a tensile break strength of 20% (ASTM D638) or more and containing a dye-permeating lubricant consisting of an addition reaction or condensation reaction type curing silicone resin. When layer 8 consists of such a composition, resin is not transferred from the thermal transfer medium containing the sublimation dye in the transfer layer to the image forming body during thermal transfer, the thermal transfer medium is smoothly peeled from the image forming body after thermal transfer, and the dyeing resin provides a good dyeing property as that of a resin having low softening point and low glass transition point although a softening point and a glass transition point of the dyeing resin are high.

Layer 8 may be formed by mixing 5 to 15 parts of an addition reaction or condensation reaction type curing silicone resin (1 to 2 parts (solid content) of a catalyst with respect to 100 parts of a silicone resin solid content) in 100 parts of a thermoplastic polyester resin dissolved in a 2-butanol or toluene-2-butanone mixture solvent and having the above properties to obtain a thickness of 4 to 6 μm.

A fine inorganic filler powder may be added in layer 8.

Table-2 shows improvements in the blocking preventing property, dyeing property, and storage stability obtained when the addition reaction or condensation reaction type curing silicone resin is added to the thermoplastic polyester resin having a different tensile break strength and tensile break elongation as compared with those obtained when no curing silicone resin is added.

TABLE 2

| Thermoplastic Polyester Resin | 6-wt % Curing Silicon Resin Toluene Solution | Blocking Preventing Property | Dyeing Property | Storage Stability |
|---|---|---|---|---|
| Tensile Break Strength (300 kg/cm$^2$ or more to less than 800 kg/cm$^2$ (ASTM D 638) Tensile Break Elongation (20% or more to less than 200%) | 0.5 part or more to less than 1.6 parts | ○ | ○ | ○ |
| | less than 0.5 part | X | ○ | X |
| | 1.6 parts or more | ○ | Δ | X |

As is apparent from Table-2, even if the thermoplastic resin contains the addition reaction or condensation reaction type silicone resin, transfer or melting of the binder resin in the thermal transfer layer with respect to dye image forming layer 8 caused by a peeling effect of the silicone resin does not occur when the thermoplastic polyester resin forming the dye image forming layer has four or more hydroxyl groups, a tensile break strength of 300 kg/cm$^2$ (ASTM D638) or more, and a tensile break elongation of 20% (ASTM D638) or more. Therefore, only the dye can be efficiently transferred to layer 8, and density of the transfer image and storage stability, especially a light resistance and plasticizer resistance after dye transfer can be significantly improved because the dyeing resin having the above properties is selected.

EXAMPLE

Preferred examples of the present invention will be described below.

EXAMPLE 1

The following composition was coated on a polyester film at a rate of 2g/m$^2$.

| | |
|---|---|
| Polyester Resin (UNITIKA ELETEL UE 3500 (tradename)) | 10 parts by weight |
| Oil-Soluble Dye (SOT BLUE2 (tradename) available from Hodogaya Chemical Co., Ltd.) | 10 parts by weight |
| Toluene/Methyl Ethyl Ketone = 1/1 | 80 parts by weight |

A molecular weight of UNITIKA ELETEL UE 3500 as a polyester resin was 30,000 and its glass transition temperature was 35° C.

The obtained thermal transfer sheet was printed on a recording sheet with a printing voltage of 13V, a resistance of 300 Ω, and a pulse width of 1.0 to 4.5 mS. As a result, reflective density at a color forming portion corresponding to a pulse width of 1.0 mS was 0.20, and that at a color forming portion corresponding to a pulse width of 4.5 mS was 1.80. In addition, transfer of the binder resin to the recording sheet was not found.

EXAMPLE 2

A thermal transfer sheet was prepared following the same procedures as in Example 1 except that BYRON 600 (tradename) available from TOYOBO CO., LTD. was used as a polyester resin instead of UNITIKA ELETEL UE 3500. BYRON 600 had a molecular weight of 9,000 to 12,000 and a glass transition point of 47° C.

In a printed material obtained by the above thermal transfer sheet, reflective density at a color forming portion corresponding to a pulse width of 1.0 mS was 0.18, and that at a color forming portion corresponding to a pulse width of 4.5 mS was 1.75. Transfer of a binder resin to a recording sheet was not found at all.

EXAMPLE 3

A thermal transfer sheet was prepared following the same procedures as in Example 1 except that KAYASET RED G (tradename) available from NIPPON KAYAKU CO., LTD. was used as an oil-soluble dye instead of SOT BLUE 2 (tradename) available from Hodogaya Chemical Col., Ltd.

In a printed material obtained using the above thermal transfer sheet, reflective density at a color forming portion corresponding to a pulse width of 1.0 mS was 0.17, and that at a color forming portion having a pulse width of 4.5 mS was 1.73. Transfer of a binder resin to a recording sheet was not found at all.

COMPARATIVE EXAMPLE 1

A thermal transfer sheet was prepared following the same procedures as in Example 1 except that UE 3500 (polyester resin) was replaced with ESLECK BX-1 (tradename) (butyral resin) available from Sekisui Chemical Co., Ltd.

In a printed material obtained using the above thermal transfer sheet, reflective density at a color forming portion corresponding to a pulse width of 1.0 mS was 0.20, and that at a color forming portion corresponding to a pulse width of 4.5 mS was 1.78, i.e., both of which were sufficient. However, at a high density portion, a binder resin was partially transferred to a recording sheet.

COMPARATIVE EXAMPLE 2

A thermal transfer sheet was prepared following the same procedures as in Example 1 except that BYRON 300 (tradename) available from TOYOBO CO., LTD. was used as a polyester resin instead of UE 3500. BYRON 300 had a molecular weight of 20,000 to 25,000 and a glass transition temperature of 7° C.

In a printed material obtained using the above thermal transfer sheet, reflective density at a color forming portion corresponding to a pulse width of 1.0 mS was 0.18, and that at a color forming portion corresponding to a pulse width of 4.5 mS was 1.69, i.e., both of which were sufficient. However, viscosity was imported to an ink surface, and a binder resin was partially transferred to a recording sheet at a high density portion.

COMPARATIVE EXAMPLE 3

A thermal transfer sheet was prepared following the same procedures as in Example 1 except that BYRON (trade name, from TOYOBO Co., Ltd.) was used as a polyester resin instead of UE3500. The BYRON had a molecular amount of 20,000 and a glass transition point of 77° C.

In a printed material obtained using the above thermal transfer sheet, reflective density at a color forming portion corresponding to a pulse width of 1.0 mS was 0.08, and that at a color forming portion corresponding to a pulse width of 4.5 mS was 1.45. That is, density was low as a whole, and color formation especially at a low-density portion was slight and insufficient.

COMPARATIVE EXAMPLE 4

A thermal transfer sheet was formed following the same procedures as in Example 1 except that KAYASET-BLUE FR (tradename) (disperse dye) available from NIPPON KAYAKU CO., LTD. was used instead of SOT BLUE 2 (oil-soluble dye).

In a printed material obtained using the above thermal transfer sheet, reflective density at a color forming portion corresponding to a pulse width of 1.0 mS was 0.08, and that at a color forming portion corresponding to a pulse width of 4.5 mS was 1.72. That is, color formation at a low energy was insufficient.

EXAMPLE 3

A dark blue dye ink mainly consisting of a saturated copolymer polyester resin and having following formulation (A) was coated on 5.7-μm thick oriented polyester film LUMIRROR 6 CF53 (tradename) available from TORAY INDUSTRIES, INC. to a thickness of 1 μm, thereby forming a first thermal transfer layer.

Then, a dark blue ink mainly consisting of a thermoplastic vinyl acetal resin and having following formulation (B) was printed on the first thermal transfer layer by a gravure solid plate having a plate depth of 40 μm, thereby forming a dark blue thermal transfer layer (thickness=1 μm). Thereafter, a sticking preventing liquid having following formulation (C) was coated on one surface of the oriented polyester film by a gravure solid plate to form a 0.4-μm thick protective layer, thereby preparing a sublimation transfer recording medium.

Meanwhile, as a sheet-like image forming body, a dyeable resin layer (thickness=5 μm) consisting of a sublimation dye having following formulation (D) was coated on image forming sheet material paper : synthetic paper UPO IRP-150 (tradename) (thickness=150 μm) available from OJI UKA CO., LTD. to prepare an image forming sheet.

The sublimation transfer recording medium was superposed on the above image forming sheet, and transfer printing was performed by video printer VY-100 (tradename) available from Hitachi, Ltd. As a result, a dark blue printed material having clear hue and good photographic gradation reproducibility was obtained. Note that when a gloss of the material was measured, a good gloss was found even by observation performed at 85% (60° method) with naked eye.

| | |
|---|---|
| Formulation (A) Dark Blue Dye Ink | |
| Disperse Dye (KAYASET BLUE FR: NIPPON KAYAKU CO., LTD.) | 10 parts by weight |
| Saturated Copolymer Polyester Resin (KEMIT K 1294: TORAY INDUSTRIES INK.) | 8 parts by weight |
| Ethyl Cellulose (N-7: Hercules Co.) | 2 parts by weight |
| Toluene | 30 parts by weight |
| Isopropyl Alcohol | 30 parts by weight |
| Methyl Ethyl Ketone | 40 parts by weight |
| (An ink was prepared by grinding by a ball mill for 20 hours.) | |
| Formulation (B) Dark Blue Dye Ink | |
| Disperse Dye (KAYASET BLUE FR: NIPPON KAYAKU CO., LTD.) | 10 parts by weight |
| Polyvinyl Butylar (BX-1: Sekisui Chemical Co., Ltd.) | 8 parts by weight |
| Ethyl Cellulose (N-7: Hercules Co.) | 2 parts by weight |
| Toluene | 30 parts by weight |
| Isopropyl Alcohol | 30 parts by weight |
| (An ink was prepared by grinding by a ball mill for 20 hours.) | |
| Formulation (C) Sticking Preventing Liquid | |
| Surface Active Agent (TR-20: MATSUMOTO YUSHI) | 3 parts by weight |
| Water | 47 parts by weight |
| Ethyl Alcohol | 50 parts by weight |
| (A liquid was prepared by agitating and mixing by a homomixer for 30 minutes.) | |
| Formulation (D) Dyeable Resin Liquid On Image Forming Sheet | |
| Polyester Resin (BYRON 103: TOYOBO CO., LTD.) | 15 parts by weight |
| Toluene | 50 parts by weight |
| Methyl Ethyl Ketone | 34 parts by weight |
| Silicon (KS770A: Shin-Etsu Chemical Co., Ltd.) | 1 part by weight |
| Hardening Agent (PL-8: Shin-Etsu Chemical Co., Ltd.) | 0.08 part by weight |
| (A liquid was prepared by agitating and mixing by a homomixer for 30 minutes.) | |

EXAMPLE 4

A 20-wt % thermoplastic polyester resin (having four or more hydroxyl groups, a tensile break strength of 500 kg/cm$^2$ or more, and a tensile break elongation of 28% or more (ASTM D638)) dissolved in aromatic and ketone solvents was coated on the surface of a polypropylene resin synthetic paper substrate to a dry film thickness of 5 μm. Then, a 6-wt % toluene solution of curing silicon resin X-62-2112 (tradename) available from Shin-Etsu Silicon (containing 10 parts of CAT PL-8 (tradename) available from Shin-Etsu Silicon with respect to 100 parts of X-62-2112) was overcoated and dried at a high temperature of 100° C. or more for 20 seconds or more to form a 0.5-μm thick curing silicon resin layer (surface resin layer), thereby preparing a thermal transfer image forming body of the present invention. Thereafter, printing was performed on this image forming body by a thermal printer or the like using a thermal transfer medium including a sublimation dye with an energy amount of 1 mJ/dot. As a result, a good image having an image density of 1.3 or more (solid portion) was obtained. In addition, when the image adhered with a mending tape (Scotch Co.) was left to stand under the conditions of 40° C. and 90% RH for 48 hours, dye transfer to the mending tape was not found.

EXAMPLE 5

A mixture of 10 parts by weight of a 20-wt % thermoplastic polyester resin solution dissolved in aromatic and ketone solvents and 10 parts by weight of a 62-wt % toluene solution of curing silicone resin X-62-2112 (tradename) available from Shin-Etsu Silicone (containing 10 parts of CAT PL-8 (tradename) available from Shin-Etsu Silicone with respect to 100 parts of X-62-2112) was coated on the surface of a polypropylene resin synthetic paper substrate and then dried at a high temperature of 100° C. or more for at least 20 seconds to form a 5-μm thick dye image forming layer, thereby obtaining a thermal transfer image forming body. Then, a thermal transfer medium containing a sublimation dye was printed by a thermal printer or the like. As a result, a good image having an image density of 1.3 or more (solid portion) was obtained with an energy amount of 1 mJ/dot. In addition, when the image adhered with a mending tape (Scotch Co.) was left to stand under the conditions of 40° C. and 90% RH for 48 hours, dye transfer to the mending tape was not found.

What is claimed is:

1. A thermal transfer image forming body comprising: a supporting body; a dyeing image forming layer formed on the supporting body and consisting mainly of a thermoplastic resin having four or more hydroxyl groups per molecule, a tensile break strength of 300 kg/cm$^2$ (ASTM D638) or greater, a tensile break elongation of 20% (ASTM D638) or greater, and a dyeing property with respect to a sublimation or hot-melt transfer dye; and a surface layer formed on the dyeing image forming layer and containing a dye-permeating lubricant consisting of an addition reaction or condensation reaction curing silicon resin.

2. A thermal transfer image forming body comprising: a supporting body; and a dyeing image forming layer, formed on the supporting body, consisting mainly of a thermoplastic resin having four or more hydroxyl groups per molecule, a tensile break strength of 300 kg/cm$^2$ (ASTM D638) or greater, a tensile break elongation of 20% (ASTM D638) or greater, and a dyeing property with respect to a sublimation or hot melt migration dye, and containing a dye-permeating lubricant consisting of an addition reaction or condensation reaction curing silicone resin.

3. A thermal transfer system which comprises:

(a) a thermal transfer recording medium comprising: a film-like supporting body consisting of a polyester resin; a first thermal transfer layer, formed on the supporting body, consisting mainly of a saturated polyester copolymer having a molecular weight of 8,000 to 30,000, and containing a sublimation or hot-melt transfer dye; and a second thermal transfer layer, formed on the first transfer layer and consisting mainly of a thermoplastic vinyl acetal resin, and containing a sublimation or hot-melt transfer dye of the same color as that of the first thermal transfer layer; and (b) a thermal transfer image forming body comprising: a supporting body; and a dyeing image forming layer, formed on the supporting body, consisting mainly of a thermoplastic resin having four or more hydroxyl groups per molecule, a tensile break strength of 300 kg/cm$^2$ (ASTM D638) or greater, a tensile break elongation of 20% (ASTM D638) or greater, and a dyeing property with respect to a sublimation or hot-melt migration dye, and containing a dye-permeating lubricant consisting of an addition reaction or condensation reaction curing silicon resin.

* * * * *